US006213597B1

(12) United States Patent
Liu

(10) Patent No.: US 6,213,597 B1
(45) Date of Patent: Apr. 10, 2001

(54) APPARATUS FOR INK CARTRIDGE OF A JET PRINTER

(76) Inventor: Win-Yin Liu, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 09/515,392

(22) Filed: Feb. 29, 2000

(51) Int. Cl.[7] ..... B41J 2/175; B65D 5/72; B65D 53/02; B65B 3/04

(52) U.S. Cl. ..... 347/85; 222/567; 141/18; 141/25; 215/352

(58) Field of Search ..... 347/85, 84, 86, 347/87; 346/140.1; 222/325, 567, 523; 141/18, 21, 25; 215/341, 346, 352

(56) References Cited

U.S. PATENT DOCUMENTS 3,563,415 * 2/1971 Ogle ..... 222/145.1
4,539,895 * 9/1985 Tanaka et al. ..... 92/249
5,883,652 * 3/1999 Moser et al. ..... 347/85
5,920,333 * 7/1999 Bates ..... 347/85

FOREIGN PATENT DOCUMENTS

1163527 * 9/1958 (FR) ..... 141/21

* cited by examiner

*Primary Examiner*—David F. Yockey
(74) *Attorney, Agent, or Firm*—Dougherty & Troxell

(57) ABSTRACT

An apparatus for the ink cartridge of a jet printer, which mainly comprises an ink-storage container and a cylinder; the ink-storage container has a cylindrical body portion, of which the bottle mouth is furnished with a retaining ring and screw threads to be connected with a piston ring and a threaded cap respectively so as to store ink; one end of the cylindrical body portion is furnished with an outer body portion having a large diameter; the cylindrical body portion and the inner cylinder of the cylinder are assembled together; the piston ring of the bottle mouth is in close contact with the inner cylinder; the front end of the sealed surface of the cylinder is furnished with a tapered ink straw to be plugged and connected with a through hole of the ink cartridge; hold the outer surface of the cylinder, and then the thumb pushes the shoulder portion of the ink-storage container upwards so as to generate a negative pressure for replenishing ink into the ink cartridge.

4 Claims, 13 Drawing Sheets

APPARATUS FOR INK CARTRIDGE OF A JET PRINTER

Background of the Invention

1. Field of the Invention

This invention relates to an ink cartridge of a jet printer, and particularly to an apparatus for ink cartridge of a jet printer.

2. Description of the Prior Art

In the conventional jet printer, the ink is loaded in a cartridge, and the ink jetted on the printing paper is controlled with a sprayer; when ink in the cartridge is used up, the cartridge has to be replaced for further printing operation; however, the ink cartridge supplied by the original manufacturer is considerably expensive, i.e., a user to print a lot of papers will spend a lot of money.

In the conventional ink cartridge of a jet printer, the ink chamber of the ink cartridge is usually loaded with an equalization air bladder or a piece of sponge for soaking and supplying ink. The ink cartridge supplied by the original manufacturer Unusually has an equal pressure in the ink chamber during the automatic manufacturing process, and there will be no leak during printing operation.

When refilling ink into a conventional hollow ink cartridge, and if such ink cartridge is furnished with an equalization air-bladder in the ink chamber thereof, a sticky tape should be used to close the air vent of the maze passage on the bottom of the ink cartridge so as to prevent ink from leaking; then, the intake hole of the airbladder should also be closed with sticky tape so as to maintain equalization of pressure; then, use a sharp point to press the seal bead out of its position so as to provide a refilling hole. Take a suitable amount of ink with a syringe, and then inject the ink into the refilling hole on the ink cartridge slowly until the cartridge being full; use a rubber plug to seal the refilling hole, and then tear off the sticky tapes on the intake hole and on the bottom of the ink cartridge respectively; it is quite often that the opening end of the maze passage or the jet nozzle would have a leakage of ink after the sticky tape on the bottom of cartridge being removed because of the pressure in the ink chamber not being equalized. To overcome such leakage, the only method is to rub off the ink leaked slowly until the leak stopped.

In the conventional ink cartridge loaded with a sponge, an empty ink cartridge can be replenished by sealing and closing the end opening of the output port by means of a glue paper; then, a center through hole on lid of the top surface of the ink cartridge is sealed with a membrane; a syringe is sucked with a suitable amount of ink. A slender hollow needle is used to stab through the membrane on the through hole, and to the most lower portion of the storage chamber so as to inject ink in the storage chamber; however, the sponge in the storage chamber contains a great amount of bubbles, and the ink injected is unable to exhaust the air therein; as a result, the ink injected in is limited. Since there is a mesh furnished between the storage chamber and the second chamber, if air in the second chamber is unable to exhaust, the ink in the storage chamber will be unable to enter the second chamber via the mesh, and the ink will be unable to flow into the spraying chamber.

When the ink cartridge on a printer fails to print continuously, the major cause is that the sprayer in the printing head is in short supply of ink, i.e., lack of sufficient ink flowing through the passage defined by the bearing member; in other words, if too much air enters the second chamber in the printing head, such air would enter the storage chamber of the sprayer to cause interruption of ink, i.e., having no ink to spray out; in the event of no ink to spray out of the sprayer for a considerable time, the sprayer might be burned out.

In the former application Ser. No. 09/328,378, "An Ink-replenishing Device for Ink Cartridge of A Jet Printer" of the applicant, the device comprises an outer cylinder and an inner cylinder; the outer end of the outer cylinder is furnished with a thread cap of the ink straw; the inner surface thereof is to receive the inner cylinder. One end of the inner cylinder that faces the ink straw has an empty part, of which the outer end is mounted with a ring seal having a plurality of contact rings to be in close contact with the inner surface of the outer cylinder. When the disk member of the inner cylinder is pushed to the shortest distance from the lugs of the outer cylinder, a suitable amount of ink will be stored in the front end of the outer and inner cylinders. After the ink-injection cylinder is connected with the ink-injection hole of the ink cartridge, the air in the ink-storage chamber will be evacuated first by means of vacuum suction before filling ink into the ink-storage chamber of the ink cartridge by means of negative pressure method; after the aforesaid procedures being done for several times, there will be no bubbles or air left in the sponge of the ink-storage chamber and the second chamber.

SUMMARY OF THE INVENTION

The prime feature of the present invention is that the former application Ser. No. 09/328,378, "An Ink-replenishing Device for Ink Cartridge of A Jet Printer" will further be improved; for instance, the ink is to be stored in an isolated ink-storage container, which is to be mounted in a cylinder with an ink straw by means of a piston ring mounted on the bottle mouth of the ink-storage chamber. The ink straw on the front end of the cylinder is to be connected with the ink-injection hole of the ink cartridge of a jet printer, and then the ink in the ink-storage container will be filled into the ink-storage chamber of the ink cartridge by means of a negative pressure method.

Another feature of the present invention is that the bottle mouth of the ink-storage container is furnished with screw threads and a retaining ring; the retaining ring is to be mounted with a piston ring. The screw threads on the bottle mouth is to be mated with a threaded cap so as to form into an isolated ink-storage container for storing ink to be used in an ink cartridge of a jet printer. After the threaded cap is removed from the ink-storage container, the piston ring on the bottle mouth will be plugged into the inner cylinder of the cylinder; the ink straw on the front end of the cylinder is to be connected with the through hole of the ink cartridge; hold the cylinder with a hand, and push the ink-storage container upwards with thumb so as to generate a negative pressure between the ink-storage container and the ink-storage chamber of the ink cartridge; the ink in the ink-injection cylinder will be injected quickly into the ink-storage chamber to have the sponge soaked with ink completely.

Still another feature of the present invention is that the ink-storage container includes a cylindrical body portion to be plugged in the cylinder and an outer body portion having a larger diameter. The piston ring on the cylindrical body portion is to be plugged into the inner cylinder of the cylinder so as to form into a sealed chamber having a large capacity; the sealed chamber can communicate with the outside only through the ink straw. To fill the ink cartridge with ink, the ink straw should be connected with the through hole of the ink cartridge, and then push the ink-storage container outwards with thumb so as to have the sealed space in the ink-storage container increased, and to generate the negative pressure in the sealed space in order to evacuate the air and bubbles from the ink-storage chamber and the sponge. As soon as the pushing force to the ink-storage container is removed, the negative pressure in the ink-storage chamber will force ink in the ink-injection cylinder to flow into the ink cartridge before the pressure being set in a balance condition.

A further feature of the present invention is that the ink straw for connecting the cylinder and the ink cartridge is furnished in the center or one side of the sealed surface of the cylinder, and it is molded with the cylinder together as one piece.

A still further feature of the present invention is that the ink straw for connecting the cylinder and the ink cartridge has a connecting stem in the center of the sealed surface of cylinder, and the connecting stem includes a connector with an ink straw; the connector is connected together with the connecting stem by means of screw threads.

Yet another feature of the present invention is that the ink straw on the outer end of the cylinder is designed into a short tapered member, of which the outer surface is connected together and closely with the ink-injection hole of the ink cartridge.

Yet still another feature of the present invention is that the larger diameter of the outer body portion of the ink-storage container is approximately equal to the maximum diameter of the lugs of the cylinder. In ink-filling operation, hold the cylinder with a hank, and push the shoulder portion upwards with thumb, and the ink-filling operation will be done.

DETAILED DESCRIPTION OF THE PREFERRED EMBODIMENT

Figure 1:
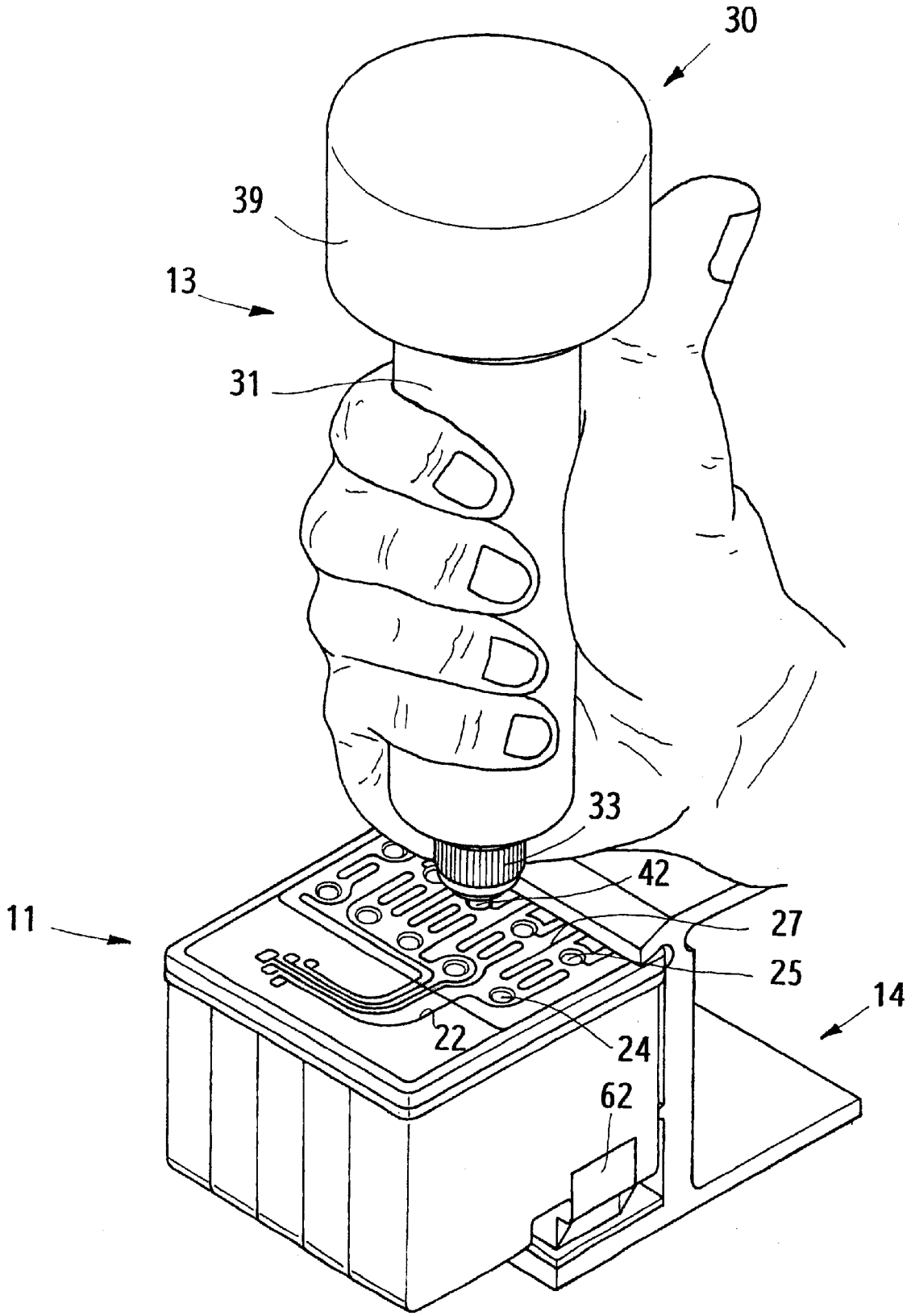
FIG. 1 shows the ink cartridge and ink-injection cylinder assembled together for replenishing ink.
Figure 2:
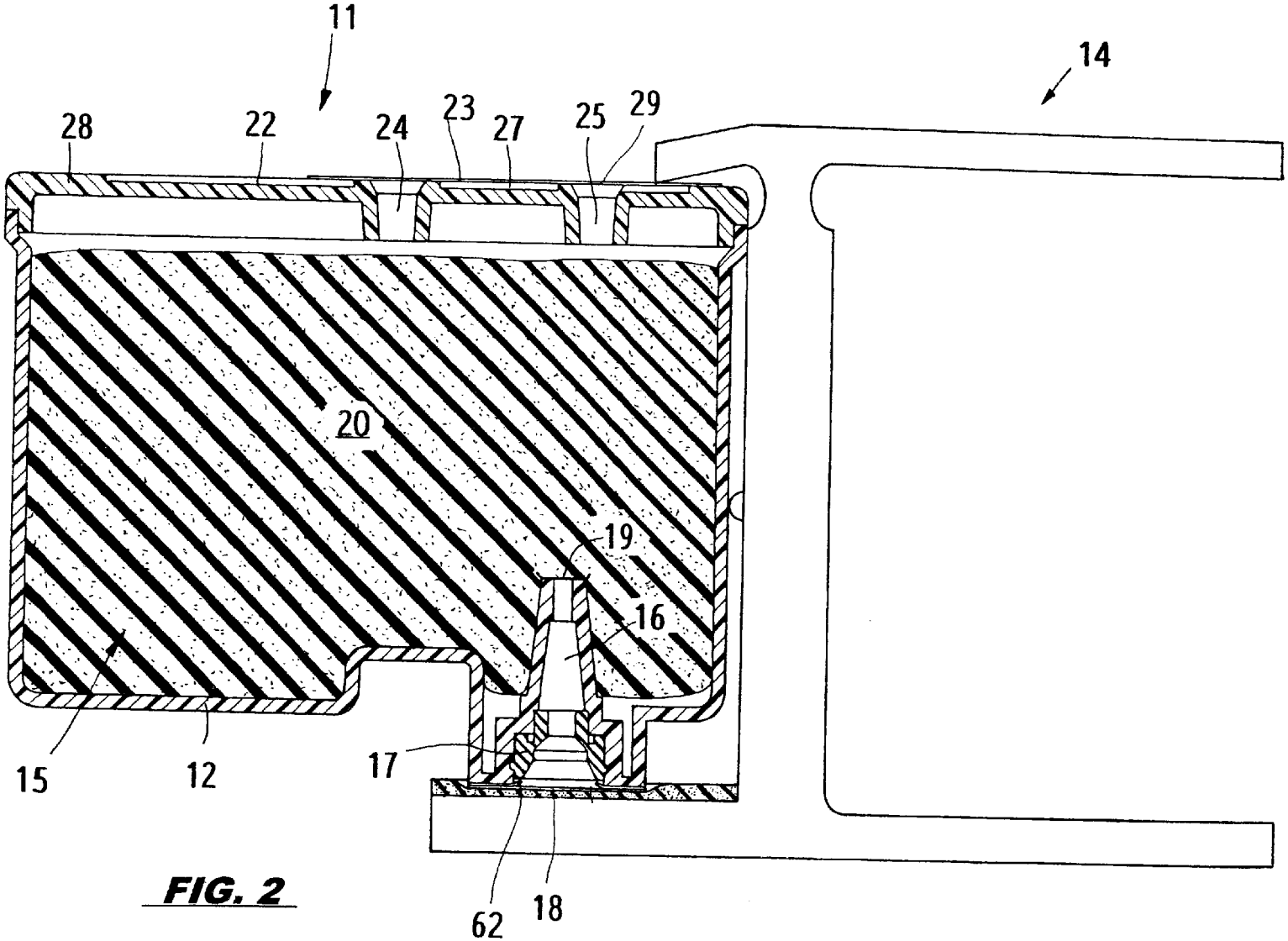
FIG. 2 is a sectional view of the ink cartridge, showing the inner structure thereof.

Referring to FIGS. 1 to 2, an ink cartridge 11 of Epson color jet printer (S020110) is shown. The inner space of the body part 12 of the ink cartridge 11 includes several isolated ink-storage chambers 15 in accordance with different colors of ink; every ink-storage chamber 15 is loaded with a sponge 20; the lower part of every ink-storage chamber 15 is mounted with a mesh 19 to isolate the second chamber 16 so as to prevent the impurities of ink in the ink-storage chamber 15 from entering the second chamber 16. By means of siphon effect, the ink can flow into the second chamber 16 of each ink-storage chamber 15; the second chamber 16 is not a large one. When assembling the ink cartridge 11, a hermetic gasket 17 is first mounted in the second chamber 16 on the output port of the ink cartridge 11; the end opening thereof is sealed with an isolation film 18, and then a sponge 20 is loaded in the ink-storage chamber 15 of every body part 12. The top of the body part 12 is sealed with a cap, of which the top surface 28 is furnished with a plurality of maze grooves 22 in accordance with the corresponding number of the ink-storage chambers 15. The tail and of every maze groove 22 has a through hole 25 in communication with the chamber 15, and another through hole 24 for replenishing ink, i.e., the top surface 28 is furnished with two through holes 24 and 25; the prime object thereof is that the through hole 24 is used for plugging an ink needle into the sponge 20. The ink needle and the through hole 24 are connected together hermetically; the other end of the through hole 25 is connected hermetically with an independent connector of a vacuum sucking assembly. The ink can be directed to flow into the sponge 20 in the ink-storage chamber 15 of the ink cartridge 11 by means of a vacuum sucking force of a vacuum sucking assembly, and simultaneously the air in the sponge 20 and the second chamber 16 will be exhausted. After the top surface 28 of the cap on the ink cartridge 11 is sealed thermally with a membrane 23, the two through holes 24 and 25, and the maze groove 22 will be formed into a maze passage 27. The ink-storage chamber 15 of the ink cartridge 11 will be in communication with the atmosphere via the fine maze passage 27. The sponge 20 in the ink-storage chamber 15 provides a function of sucking ink and of balancing the inner pressure of the ink-storage chamber 15. Before the ink cartridge 11 being used, the maze passage 27 of the top surface 22 would not cause ink to be leaked out. After the ink cartridge 11 and the printer are assembled together, the isolation film 18 attached to the output port will be stabbed through by the guide straw of the connecting seat; then, the hermetic gasket 17 of the output port will be in close contact with the guide straw of the connecting seat. The ink soaked in the sponge 20 of the ink-storage chamber 15 will be consumed and reduced upon printing operation being under way until the sponge 20 unable to supply ink via the mesh 19 and to enter the second chamber 16; then, the ink cartridge should be replaced with a new one so as to provide the printer with ink continuously.

In fact, the isolation film 18 attached to the output port will be broken upon replenishing ink for the ink cartridge 11 with sponge 20. After the ink cartridge 11 is separated from the connecting seat of the printer, air will enter the second chamber 16 of the ink cartridge 11 .When replenishing ink, the output port of the ink cartridge 11 must be sealed with a glue paper 62, which is glued over the isolation film 18. In order to seal the output port of the ink cartridge 11 surely, a protection clamp 14 is used during replenishing ink so as to have the output port sealed correctly.

Referring to FIGS. 1, 2, 9 and 10, the ink-replenishing apparatus for ink cartridge of a jet printer is mainly used for a used and empty ink cartridge 11. The output part of the second chamber 16 of the ink cartridge 11 should be sealed with a glue paper 62 first, and the output part of the ink cartridge 11 is held with a protection clamp 14 so as to prevent the output port from leaking ink. Let the ink straw 42 of the ink-injection cylinder stab through a membrane 29 covered a through hole 25 of the ink cartridge 11, and let the ink straw 42 and the through hole 25 be in close contact; let hand hold the cylinder 31 of the ink-injection cylinder 13, and let the thumb contact with the shoulder portion 36 of the outer body portion 39, and then push the ink-storage container 30 upwards. When the sealed space between the ink-injection cylinder 13 and the ink cartridge 11 is expanded in terms of capacity, a negative pressure will be generated; then, the air in the ink-storage chamber 15 will be sucked into the upper portion of the ink chamber 48 of the ink-storage container 30 of ink-injection cylinder 13. As soon as the pushing force applied to the ink-storage container 30 is exhausted, the ink in the ink-storage container 30 will flow into the ink-storage chamber 15 by means of a negative pressure, and will be soaked into the sponge 20.

Figure 3:
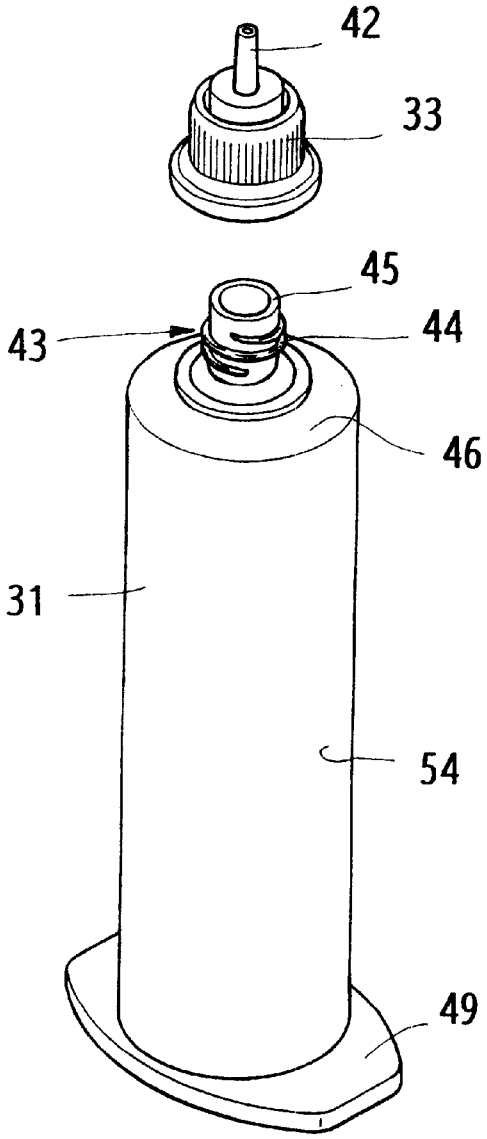
FIG. 3 is a disassembled view of the cylinder according to the present invention.
Figure 4:
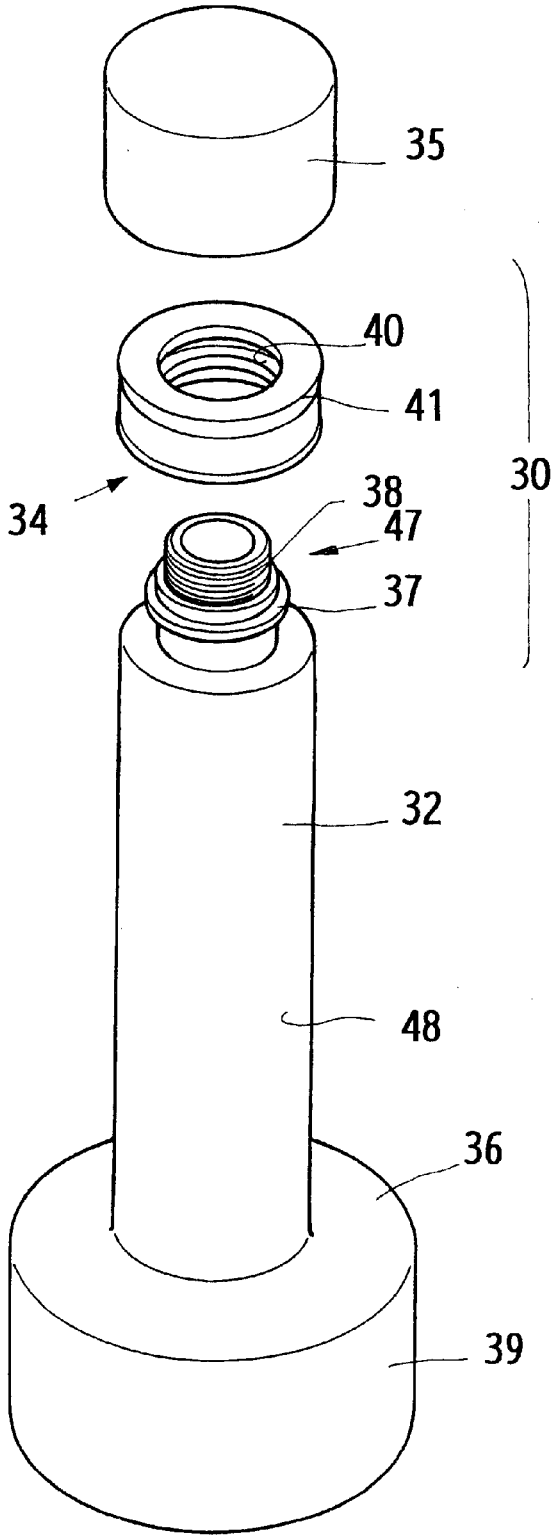
FIG. 4 is a dissembled view of the ink-storage container according to the present invention.
Figure 5:
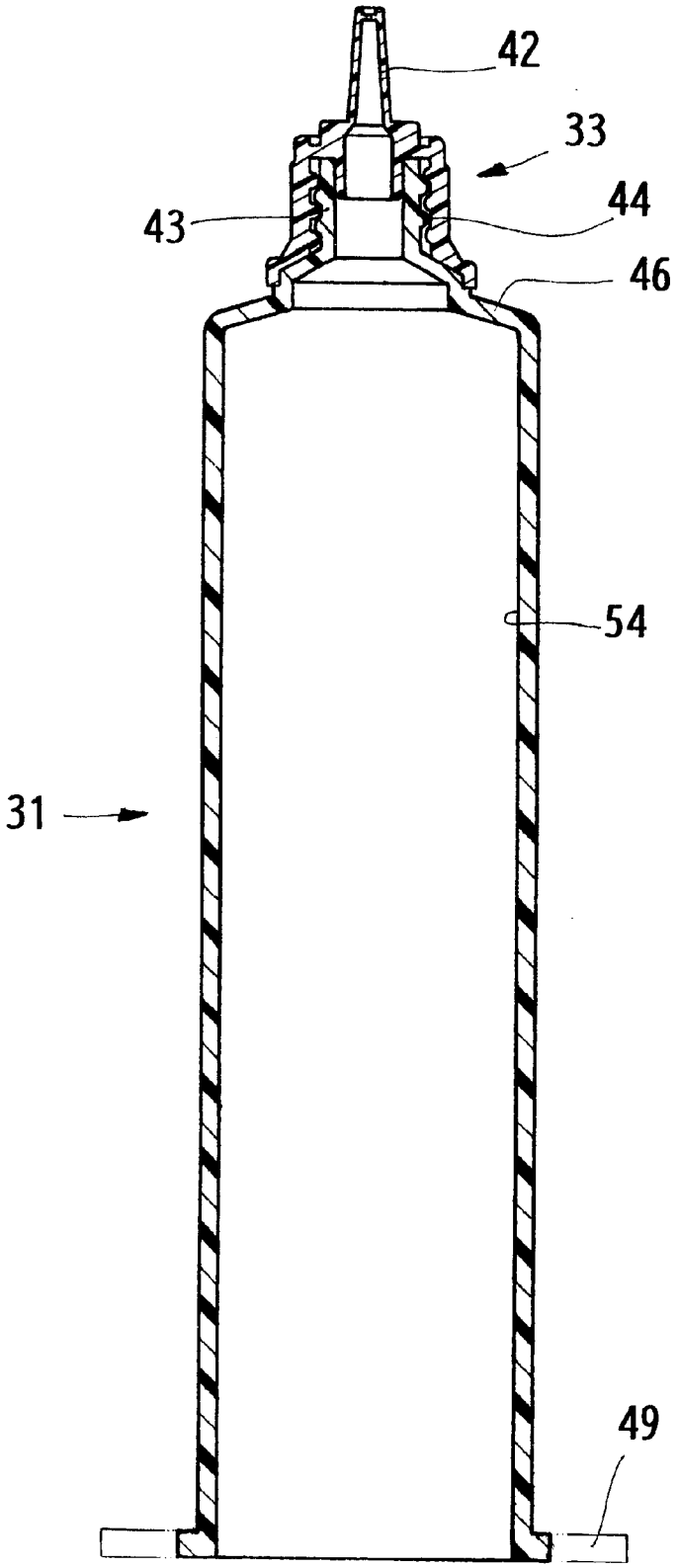
FIG. 5 is a sectional view of the cylinder, showing an ink straw assembled together with the cylinder by means of a threaded cap.
Figure 6:
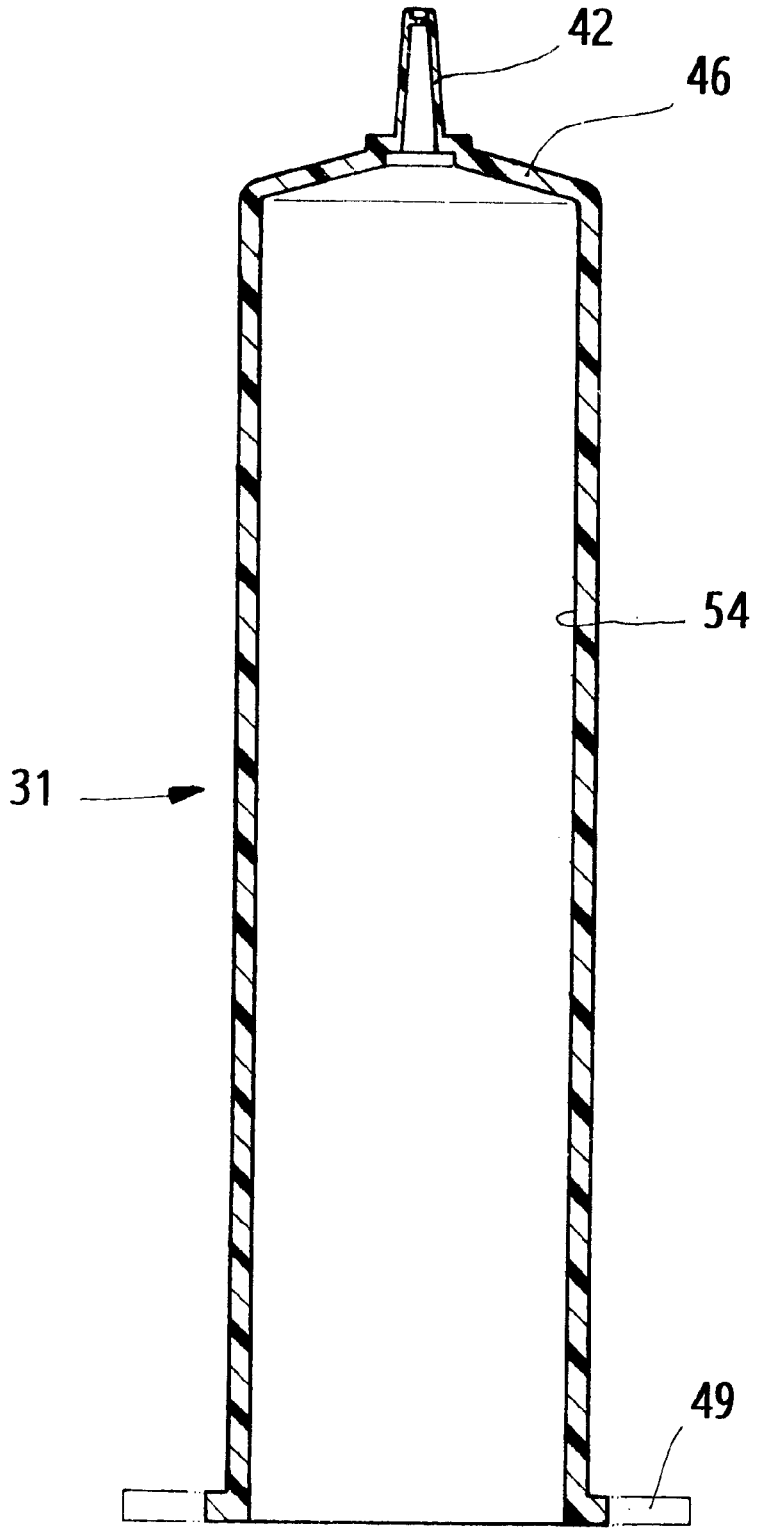
FIG. 6 is a sectional view of the cylinder, showing the ink straw being molded together with the cylinder as one piece.
Figure 7:
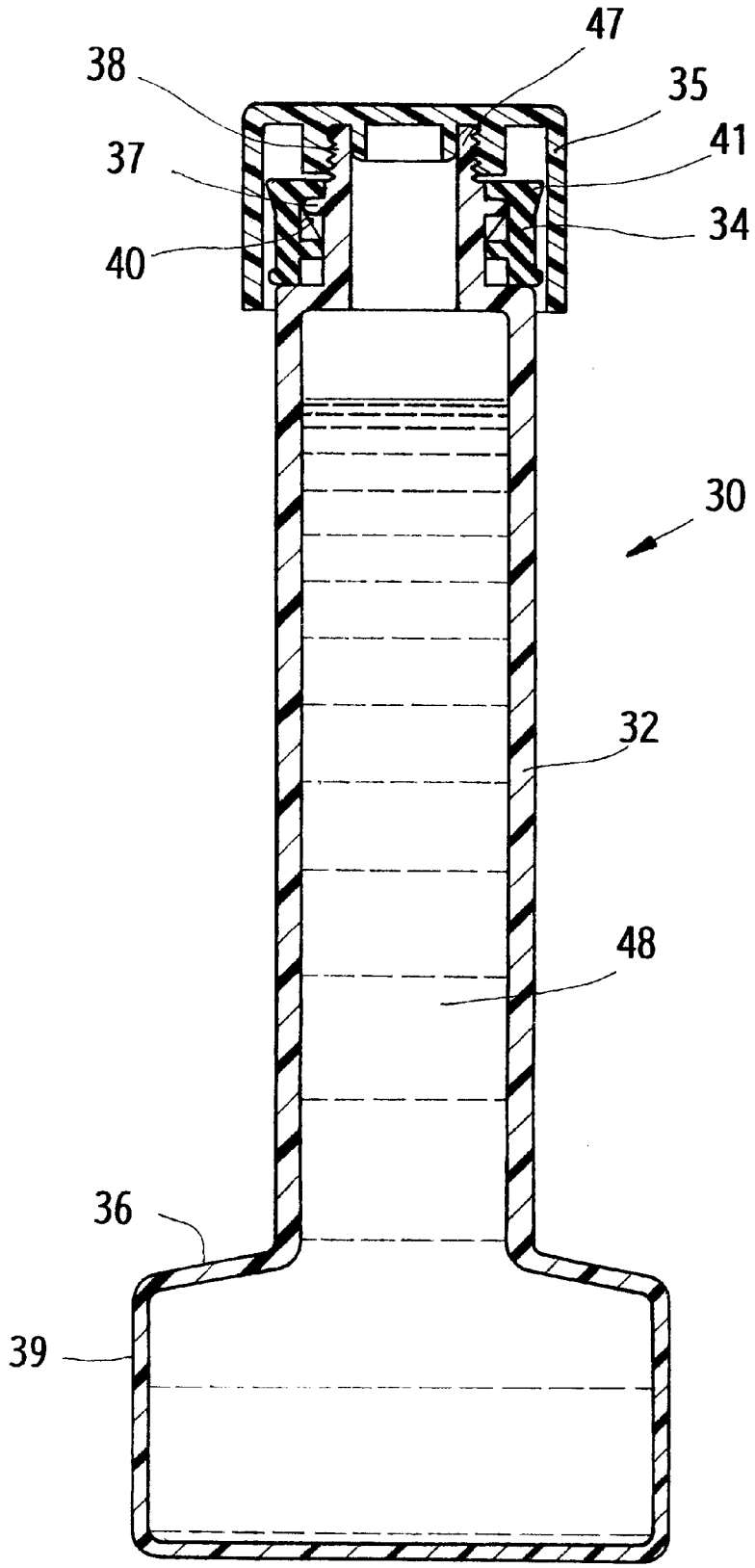
FIG. 7 is a sectional view of the ink-storage container, showing the structure thereof.
Figure 11:
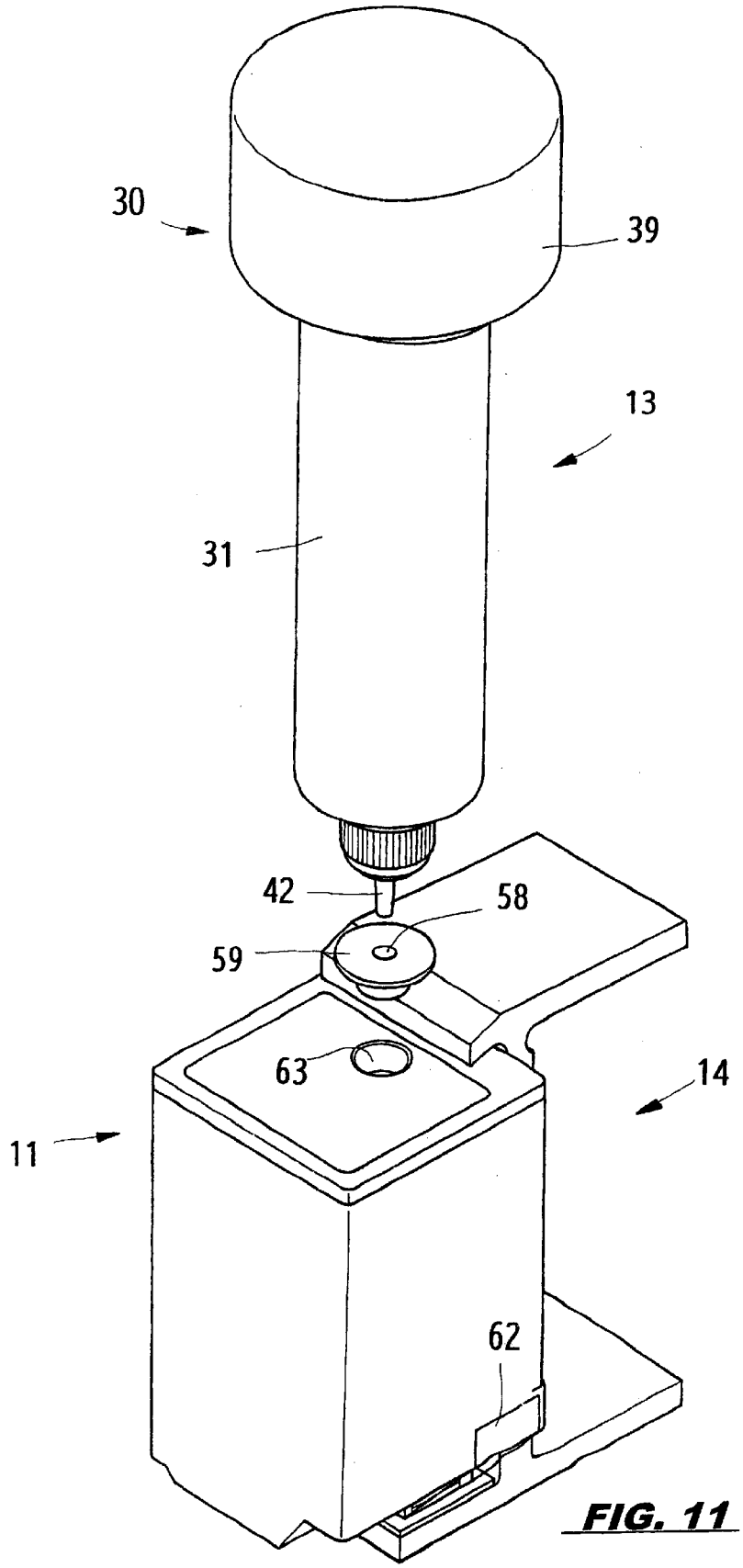
FIG. 11 to 13 are perspective views of the present invention, showing the relation between the ink-injection cylinder and the different embodiments.
Figure 12:
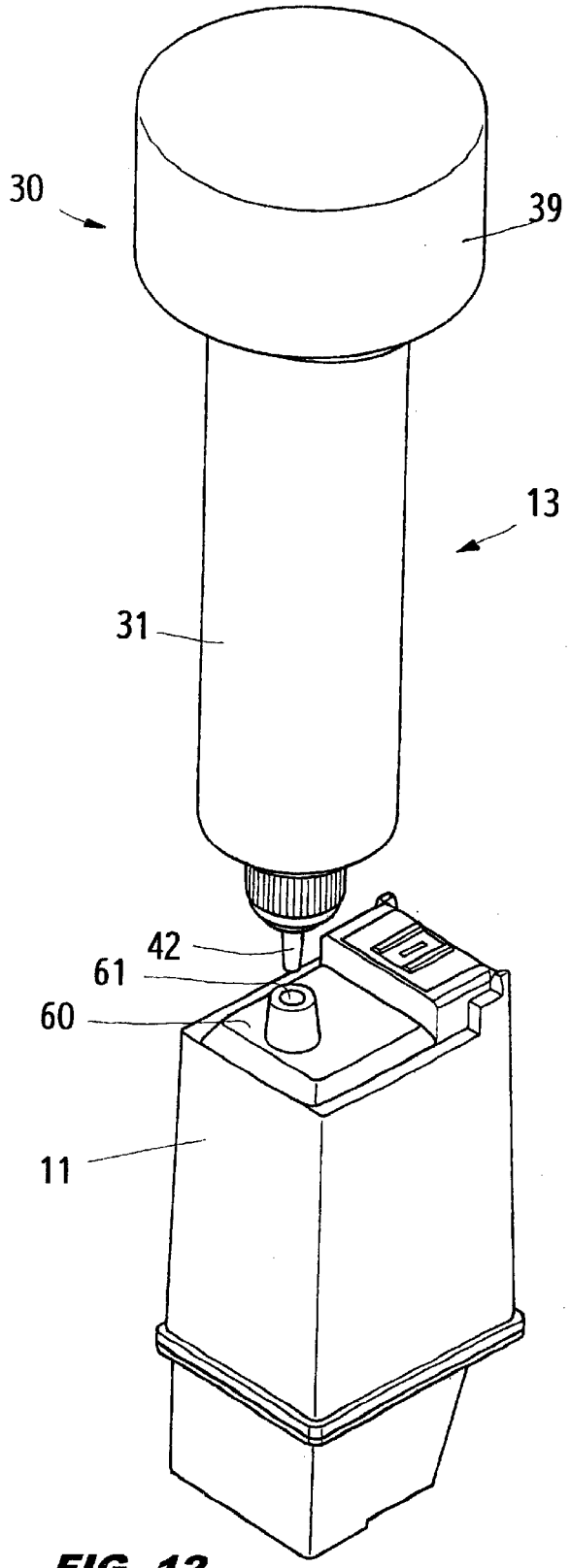

As shown in FIGS. 3 to 8, the ink-injection cylinder 13 for replenishing the ink cartridge 11 includes an ink-storage container 30 and a cylinder 31; the cylinder 31 is substantially a syringe in terms of shape, and the center part thereof has an inner cylinder 54 in close contact with a piston ring 34; the lower end opening of the cylinder 31 is furnished with two symmetrical lugs 49 on two sides thereof. The upper end of the cylinder 31 has an ink straw 42. As shown in FIGS. 3 and 5, the sealed surface 46 of the cylinder 31 has a connecting stem 43 with a threaded portion 44 and a through hole 45 in the center thereof. The retaining groove 40 is to be connected with the connector 33 having a threaded cap 35; the outer end of the connector 33 is furnished with a tapered ink straw 42. As shown in FIG. 6, the center or one side of the cylinder 31 is furnished with a tapered ink straw 42 extended out of the sealed surface 46 directly. The ink straw 42 is designed to fit the diameter and taper shape of the through hole 25 as shown in FIG. 1; the ink straw 42 can stab in the through hole 25 and into the ink-storage chamber 15 of the ink cartridge 11. As shown in FIGS. 11 and 12, the through hole of the ink cartridge 11 is mounted with an auxiliary plug 59 or an auxiliary pad 60, and then the cylindrical hole 58 of the auxiliary plug 59 or the cylindrical hole 61 of the auxiliary pad 60 is connected with the ink straw 42.

As shown in FIGS. 1, 4, 7 and 8, the ink-storage container 30 of the ink-injection cylinder 13 includes a bottle body 26, a piston ring 34 and a threaded cap 35; the bottle body 26 has a cylindrical body portion 32 with a bottle mouth 47, which is furnished with a retaining ring 37 and screw threads 38. The retaining ring 37 is to be mounted with the piston ring 34; the screw threads 38 is to be mated with the threaded cap 35 so as to seal the bottle mouth 47 of the ink-storage container 30 to prevent ink from leaking.

The inner center of the piston ring 34 mounted on the retaining ring 37 has a retaining groove 40 to be mated with the retaining ring 37. Both the upper and lower edges of the piston ring have ring-shaped surfaces 41 to be in contact with an inner cylinder 54 of the cylinder 31 upon the ink-storage container 30 and the cylinder 31 being assembled together. The bottle body 26 of the ink-storage container 30 includes a cylindrical body portion 32 and an outer body portion 39 having a larger diameter; the cylindrical body portion 32 has a diameter less than that of the inner cylinder 54 of the cylinder 31 so as to fit in the inner cylinder 54. The diameter of the outer body portion 39 is approximately equal to the maximum outer diameter of the lugs 49 of the cylinder 31. A shoulder portion 36 is furnished between the cylindrical body portion 32 and the outer body portion 39 so as to provide a thumb-catch surface upon pushing the ink-storage container 30.

The space in the cylindrical body portion 32 and the outer body portion 39 of the ink-storage container 30 forms into an ink chamber 48 for storing ink. The screw threads 38 of the bottle mouth 47 is to be closed with the threaded cap 35 so as to prevent ink from leaking out of the ink-storage container 30; an outer O-ring surface 50 covers the outer surface of the piston ring 34 so as to prevent any miscellaneous matters from contacting the piston ring 34, and to prevent from leaking during handling the same.

Figure 8:
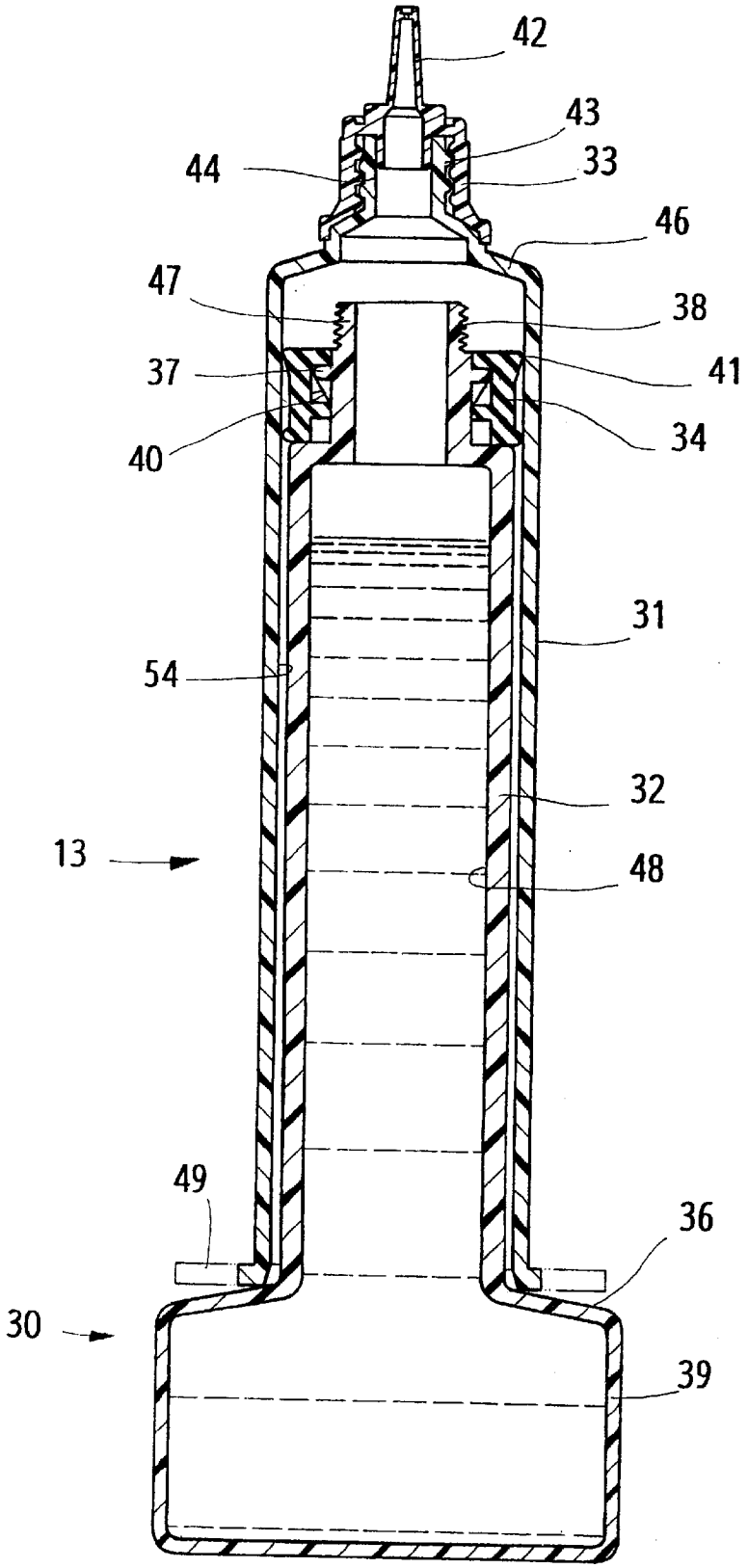
FIG. 8 is a sectional view of the present invention, showing the structure of the ink-injection cylinder.
Figure 9:
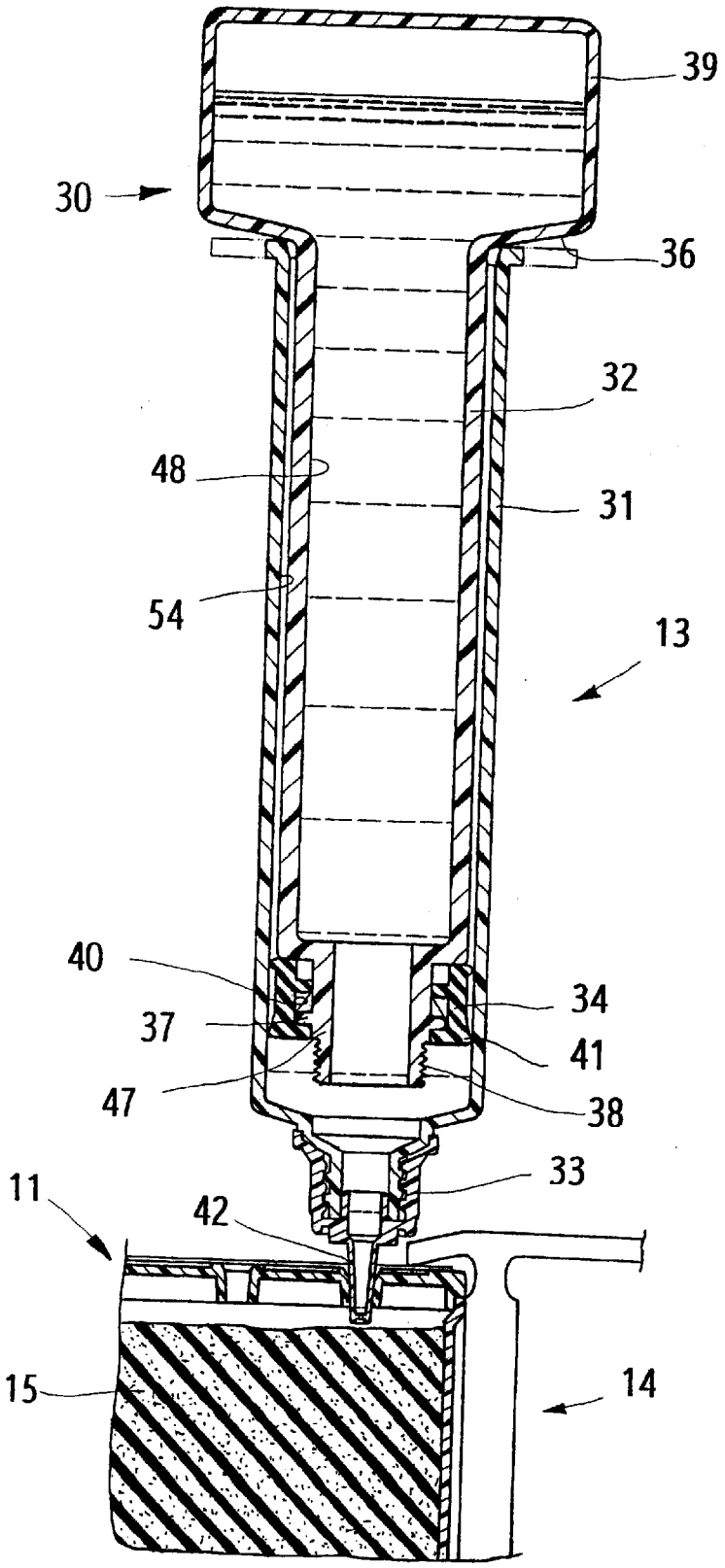
FIG. 9 is a sectional view of the present invention, showing the assembled condition between the ink-injection cylinder and the ink cartridge.

During replenishing ink for the ink cartridge 11 by using the ink-injection cylinder 13, the threaded cap 35 of the ink-storage container 30 is removed first, and then the cylinder 31 and the inner cylinder 54 are assembled together as shown in FIG. 8. The ring-shaped surface 41 of the piston ring 34 of the ink-storage container 30 is in close contact with the inner cylinder 54 of the cylinder 31. After the piston ring 34 of the ink-storage container 30 is pushed closely to the inner surface of the sealed surface 46, the outer body portion 39 having larger diameter will near the outer edge of the lugs 49 of the cylinder 31. As shown in FIG. 6, the ink straw 42 and the cylinder 31 are molded together as one piece; the center of the ink straw 42 has a through hole. As shown in FIG. 5, the front end of the cylinder 31 has a connecting stem 43 to be mounted with a connector 33; the end of the ink straw 42 is in sealed condition, and should be stabbed through with a thumb pin before using. As shown in FIG. 2, the output port of an empty ink cartridge 11 is sealed up with a protection clamp 14. As shown in FIGS. 1, 2 and 9, the ink straw 42 of the ink-injection cylinder 13 faces downwards to stab through the membrane 29 on the through hole 25 in the ink cartridge 11, and to extend into the ink-storage chamber 15; in that case, the ink straw 42 and the wall of the through hole 25 are in close contact; the ink chamber 48 of the ink-storage container 30 and the ink-storage chamber 15 of the ink cartridge 11 form into a sealed and through space.

Figure 10:
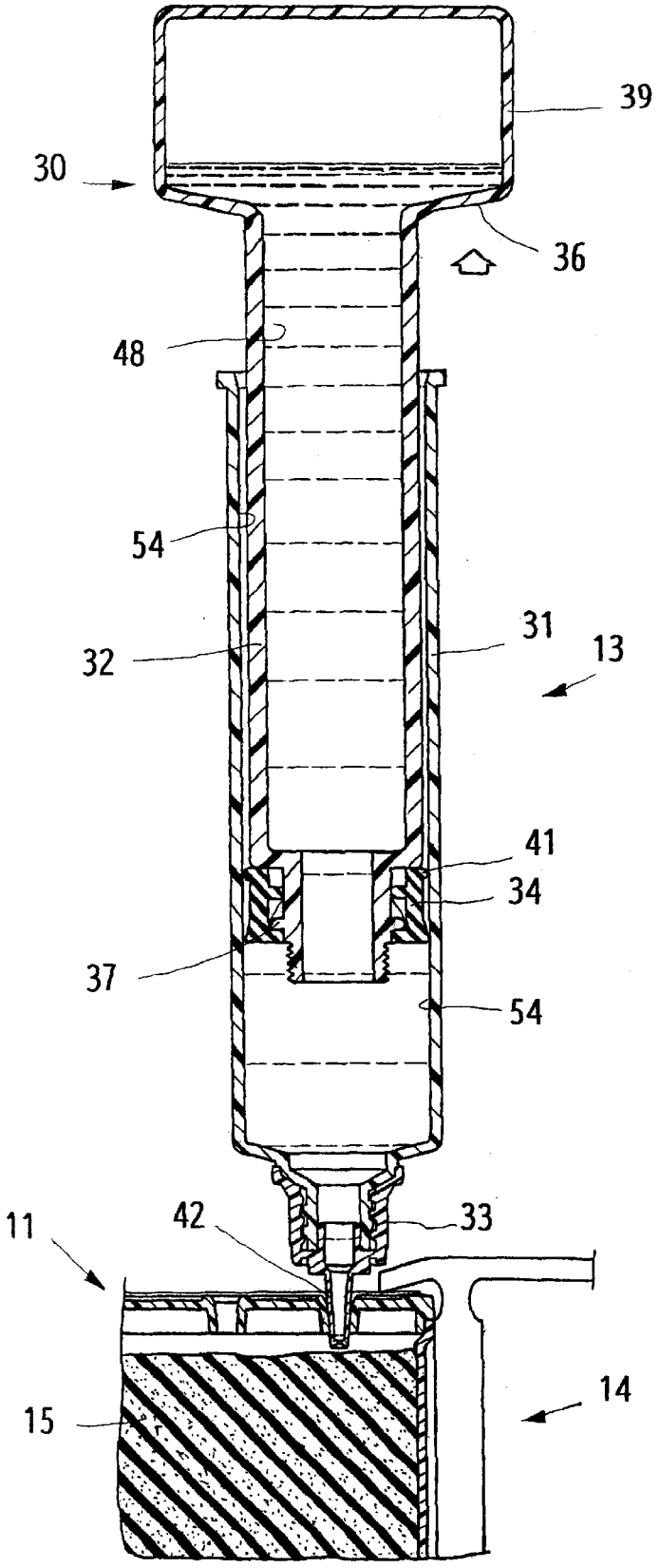
FIG. 10 is a sectional view of the present invention, showing the ink-injection cylinder being pushed to move.

As shown in FIGS. 1, 9 and 10, after the ink-injection cylinder 13 and the through hole 25 of the ink cartridge 11 are connected together, the ink nearing the ink straw 42 would not drip down as a result of gravity force because of the ink-storage container 30 having a given thickness. User's hand can hold the cylinder 31, ad the thumb thereof can push the shoulder portion 36 of the ink-storage container 30 upwards at a given distance; then, the piston ring 34 will move along the surface of inner cylinder 54 to increase the capacity of the sealed space and to generate a negative pressure in the sealed space. When such negative pressure is generating in the ink-injection chamber 13, air in the ink cartridge 11 will, as a result of the negative pressure, enter the inner cylinder 54 of the cylinder 31 and the top part of the outer body portion 39 quickly. As soon as the pushing force of thumb is removed, the negative pressure in the ink-storage chamber 15 of the ink cartridge 11 and in the ink chamber 48 of the ink-injection cylinder 13 will be removed; then, the ink-storage container 30 of the ink-injection cylinder 13 will be pulled to its original position; in that case, the ink dropped to the ink straw 42 will flow into the ink-storage chamber 15. After the ink-storage container 30 being pushed upwards and being pulled back repeatedly, the replenishing operation for the ink-storage chamber 15 of the ink cartridge will be completed.

After the ink cartridge 11 is refilled, the through hole 25 on the ink-storage chamber 15 must be sealed with a glue paper to cover the membrane 23 so as to restore the original function for the maze groove 27 in order to balance the inner pressure of the ink-storage chamber 15 by means of a fine passage, through which the ink for the jet printer can be supplied.

Figure 13:
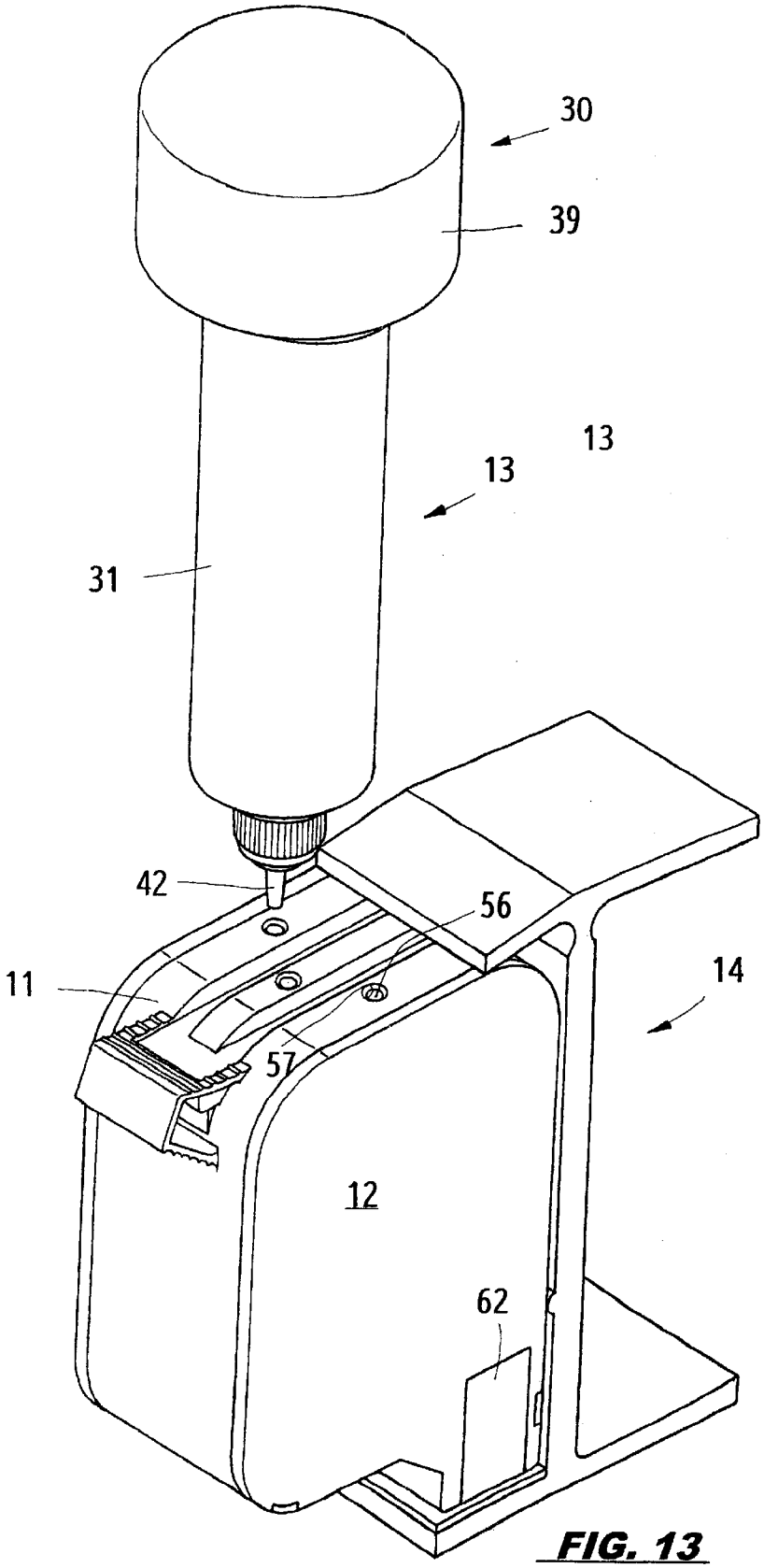

Referring to FIG. 13, an ink cartridge 11 (51641A) of HP jet printer on sale in the market is shown; the body part 12 of the ink cartridge 11 includes several isolated ink chambers corresponding to the number of ink colors; the top every ink chamber has a through hole 56; as soon as each such chamber is filled with ink, the through hole is sealed up with a ball plug 57. When the ink in a chamber 15 is used up, the output port of the second chamber of the ink cartridge 11 will be sealed up with a glue paper 62 before replenishing ink operation; then, the output port is clamped with the protection clamp 14 so as to have the output port sealed up completely. The ball plug 57 in the through hole 56 on the ink cartridge 11 can be pushed away with a pin, and then the end 53 of the ink straw 42 of the ink-injection cylinder 13 is stabbed through with a thumbtack or the like; the ink straw 42 of the ink-injection cylinder 13 is plugged into the through hole 56 of the ink cartridge 11 and the chamber, being in close contact with the wall surface of the through hole 56. User's hand holds the cylinder 31 to push the ink-storage container 30 upwards with his (or her) thumb and let it move back repeatedly so as to let the chamber generate a negative pressure; such negative pressure would provide a convection and exchange between the air in the chamber and the ink in the ink-injection cylinder 13, i.e., to exhaust the air in the sponge in the ink cartridge 11 so as to have the ink entered the sponge quickly.

Referring to FIG. 11, an ink cartridge (BC-20) of CANON jet printer on sale in the market is shown; the inside of the body part of the ink cartridge 11 includes ink-storage chamber with sponge; the top of the ink cartridge has a through hole 63, which is to be sealed up with a cylindrical hole plug. During ink-replenishing operation, the output port of the second chamber of the ink cartridge 11 should be sealed up with a glue paper 62, and clamped with the protection clamp 14 so as to have the output port sealed up completely; remove the cylindrical hole plug in the through hole 63 with a tool, and then use an auxiliary plug 59 having a cylindrical hole 58 to seal the through hole; plug the ink straw 42 of the cylinder 31 into the cylindrical hole 58 of the auxiliary plug 59, and let them contact each other hermetically. By means of the same method as mentioned in the aforesaid embodiment, the ink in the ink-storage container 30 will be injected into the sponge of the ink-storage chamber 15 of the ink cartridge 11 quickly.

Referring to FIG. 12, an ink cartridge (51626A) of a HP jet printer on sale in the market is shown; the bottom surface of the body part of the ink cartridge 11 is furnished with a maze passage for regulating the pressure in the chamber; during ink-replenishing operation, the bottom surface of the ink cartridge 11 is glued with a two-side-glue auxiliary pad 60, which has a through cylindrical hole 61 for plugging the ink straw 42 of the cylinder 31 so as to have the ink in the ink-storage container 30 injected into the sponge of the chamber 15 of the ink cartridge 11 quickly by using the same method as mentioned in the aforesaid embodiment.

Figure 14:
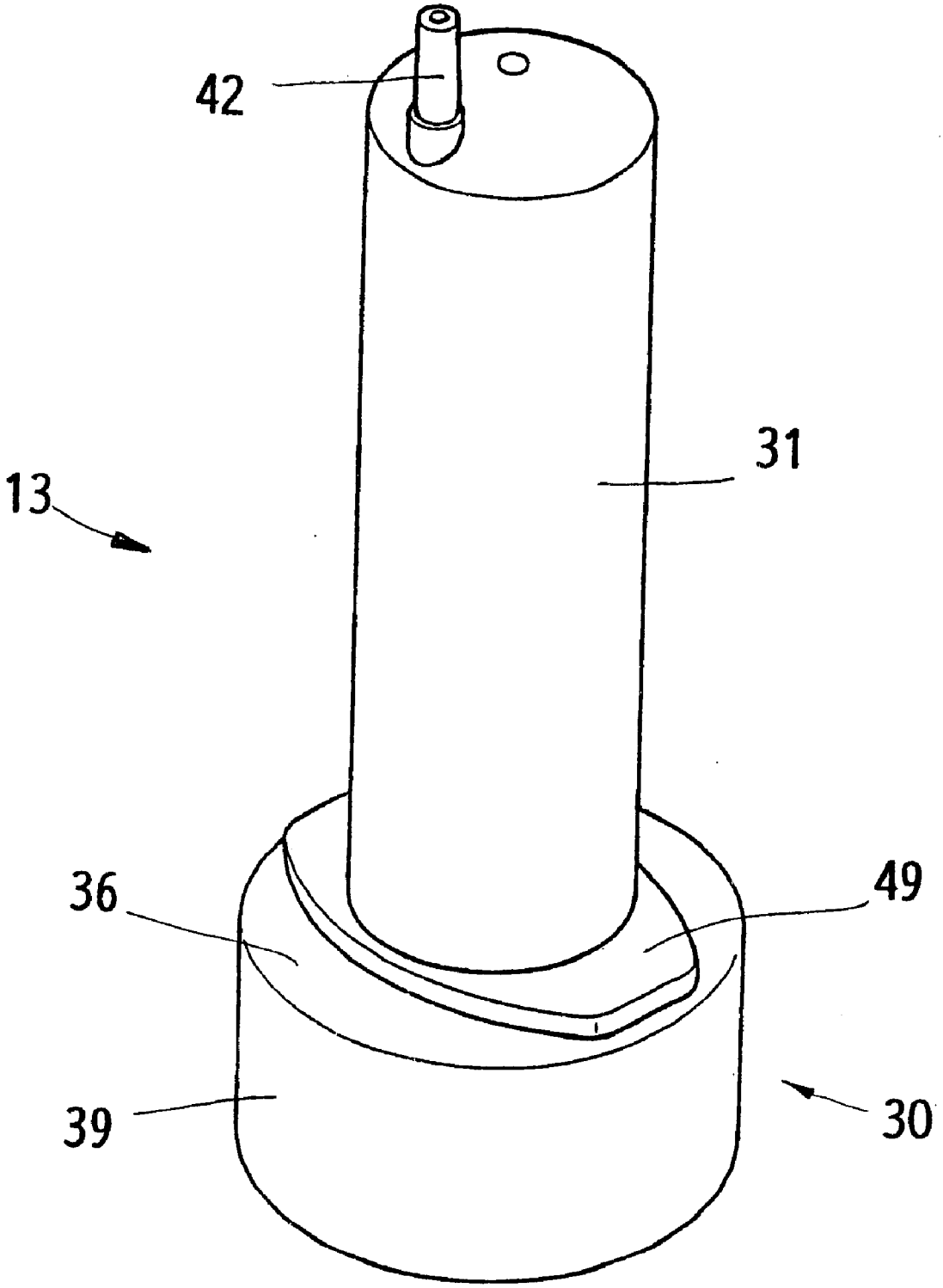
FIG. 14 is a perspective view of the third embodiment according to the present invention.

As shown in FIG. 14, the cylinder 31 is substantially a conventional syringe 51, in which one side of the sealed surface 46 thereof is furnished with a connecting stem 43. An inner cylinder 54 of the syringe 51 and the ink-storage container 30 are assembled together; the connecting stem 43 is connected with an ink straw 42; then, the ink cartridge 11 can be replenished with ink by means of the aforesaid same replenishing method.

According to the technique of the present invention, the ink-storage container 30 is an independent container, of which the bottle mouth 47 is furnished with a retaining ring 37 and screw threads 38 to be connected with the piston ring 34 and the threaded cap 35 respectively so as to have ink stored therein. Remove the threaded cap 35, and have the inner cylinder 54 of the cylinder 31 assembled with the ink-storage container; the tapered ink straw 42 on the cylinder 31 can be plugged into the through hole of the ink cartridge 11 directly; such connection may be done by using an auxiliary plug 59 or an auxiliary pad 60. Hold the cylinder 31 with a hand, and push the shoulder portion 36 of the ink-storage container 30 upwards so as to have the sealed space in the ink-injection cylinder 13 and the ink cartridge 11 generate a negative pressure. As soon as the pushing force is removed, the ink in the ink chamber 48 of the ink-storage container will fill into the ink-storage chamber 15 of the ink cartridge 11 as a result of balanced pressure; after the aforesaid steps are done repeatedly several times, there will be no bubbles or air left in the sponge 20 and the second chamber 16 of the ink cartridge 11. According to the aforesaid description for the embodiments, the features of structure of the ink-injection cylinder 13 and the ink replenishing method have been disclosed completely; it is apparent that the present invention has provided an evident improvement and novelty thereto; the objects anticipated have been fulfilled, and such objects have never been anticipated and accomplished by any person in the field.

What is claimed is:

1. An ink-replenishing apparatus for an ink cartridge of a jet printer comprising:

an ink-injection cylinder having an inner cylinder, a first end of said inner cylinder having an opening with lugs on said ink-injection cylinder on opposite sides of said inner cylinder, while a second end of said inner cylinder has a sealed surface, in a center of which is located an ink straw, a center of said ink straw having a through hole;

an ink-storage container including:

a bottle body including a cylindrical body portion and an outer body portion with a diameter larger than a diameter of the cylindrical body portion, said cylindrical body portion having a diameter less than a diameter of said inner cylinder and being mounted in said inner cylinder, the diameter of said outer body portion being approximately equal to a maximum dimension of said lugs of said ink-injection cylinder; a shoulder portion located between said cylindrical body portion and said outer body portion; a bottle mouth of said cylindrical body portion having a retaining ring with screw threads; a piston ring having a retaining groove mounted together with said retaining ring, upper and lower edges of said piston ring having ring-shaped surfaces respectively such that, after said ink-storage container and said ink-injection cylinder are assembled together, said ring shaped surfaces of said piston ring closely contact said inner cylinder; and, a threaded cap removably mounted on said screw threads of said bottle mouth so as to hold ink in said ink-storage container when not assembled with said ink-injection cylinder.

2. The apparatus for an ink cartridge of a jet printer as claimed in claim 1, wherein the ink-injection cylinder has a connecting stem having a threaded portion disposed at the center of said sealed surface of said inner cylinder; said connecting stem mounted with a connector having a threaded cap wherein said ink straw is located on said threaded cap and is configured to be plugged in a through hole of said ink cartridge.

3. The apparatus for an ink cartridge of a jet printer as claimed in claim 1, wherein said ink straw on said sealed surface of said inner cylinder is configured to fit a cylindrical hole of an auxiliary pad mounted on said ink cartridge.

4. An apparatus for an ink cartridge of a jet printer comprising: a syringe having an inner cylinder connected together with an ink-storage container; a front end of said syringe having a connecting stem mounted with an ink straw for filling ink into an ink-storage chamber of said ink cartridge; and said syringe including two lugs thereon; said apparatus further including:

a bottle body including a cylindrical body portion and an outer body portion with a diameter larger than a diameter of said cylindrical body portion, the diameter of said cylindrical body portion being less than a diameter of said inner cylinder so as to enable said cylindrical body portion to fit in said inner cylinder; the diameter of said outer body portion being approximately equal to a maximum dimension of said two lugs on said syringe; a shoulder portion located between said cylindrical body portion and said outer body portion; an upper bottle mouth of said cylindrical body portion having a retaining ring with screw threads; a piston ring having a retaining groove mated with said retaining ring; upper and lower edges of an outer surface of said piston ring having ring-shaped surfaces, such that when said ink-storage container and said cylinder are assembled together, said ring-shaped surfaces contact said inner cylinder of said syringe; and, a threaded cap removably mounted on said screw threads of said bottle mouth of said bottle body so as to hold ink in said ink-storage container, when not assembled with said cylinder.

* * * * *